US006050866A

United States Patent [19]

Bass

[11] Patent Number: 6,050,866

[45] Date of Patent: Apr. 18, 2000

[54] DUAL FUNCTION SINGLE LEVER CONTROL APPARATUS

[76] Inventor: Samuel J. Bass, 123 Karuk La., Roseburg, Oreg. 97470

[21] Appl. No.: 09/134,384

[22] Filed: Aug. 14, 1998

[51] Int. Cl.[7] ..... B60K 41/00

[52] U.S. Cl. ..... 440/84; 74/480 B

[58] Field of Search ..... 440/86, 84, 87, 440/41; 74/480 B

[56] References Cited

U.S. PATENT DOCUMENTS

| | | | |
|---|---|---|---|
| 4,753,618 | 6/1988 | Entringer | 440/86 |
| 4,952,181 | 8/1990 | Entringer et al. | 440/86 |
| 4,973,274 | 11/1990 | Hirukawa | 440/86 |
| 5,242,320 | 9/1993 | Schmidt et al. | 440/86 |
| 5,368,510 | 11/1994 | Richard | 440/86 |
| 5,492,493 | 2/1996 | Ohkita | 440/86 |
| 5,494,464 | 2/1996 | Kobayashi et al. | 440/86 |
| 5,538,449 | 7/1996 | Richard | 440/86 |
| 5,603,644 | 2/1997 | Kobayashi et al. | 440/86 |

FOREIGN PATENT DOCUMENTS

| | | |
|---|---|---|
| 53-20295 | 2/1978 | Japan . |
| 713-769 | 2/1980 | U.S.S.R. . |
| WO 91/04192 | 4/1991 | WIPO . |

*Primary Examiner*—Jesus D. Sotelo
*Attorney, Agent, or Firm*—Richard C. Litman

[57] ABSTRACT

A dual function single lever control apparatus for controlling the reversing bucket of a jet propulsion engine for a boat in synchronization with the throttle. A planar cam with a curvilinear slot having two legs synchronizes the dual functions with a throttle and shift lever.

11 Claims, 4 Drawing Sheets

DUAL FUNCTION SINGLE LEVER CONTROL APPARATUS

BACKGROUND OF THE INVENTION

1. Field of the Invention

The present invention relates to a dual function single lever control apparatus for a jet pump drive system of a boat involving both mixed and axial flow.

2. Description of the Related Art

The related art describes various shift and throttle controls for marine drive systems, but the art neither teaches or suggests the unique dual function single lever control apparatus of the present invention. The related art will be discussed in the order of perceived relevance to the present invention.

U.S. Pat. No. 5,242,320 issued on Sep. 7, 1993, to Edward A. Schmidt et al. describes a single lever throttle and shift control system for a water jet propulsion system energized by either electrical, hydraulic or pneumatic means and a method for employing the electrical system which includes a de-actuable switch bank, slide switches, relays, and solenoids. The apparatus is distinguishable by its reliance on electrical, hydraulic or pneumatic control means instead of the manual control means of the present invention.

Japan Patent Publication Serial No. 53-20,295 published on Feb. 24, 1978, for Masaaki Baba describes a two-lever control system for shifting the clutch and control of the governor for marine diesel engines and capable of stopping the engine. The conventional forward, neutral and reverse first lever is augmented with a second stop lever which minimizes the idling speed of the engine while the first lever is in neutral to stop the engine. A governor actuating member connected to a driving member is mechanically connected by gear teeth to a rotatable arm which actuates the clutch and the governor. The stop lever motivates an asymmetrical slotted cam with a quarter-circle slot to achieve the aforementioned stopping of the engine. The system is distinguishable because the cam is utilized for only one function which is to stop the engine, whereas the present invention involves forward and reverse controls of a bucket for a jet propulsion pump.

PCT Publication No. WO 91/04192 published on Apr. 4, 1991, for Stig Bohlen describes a single lever control with clutch and throttle for boats. An asymmetrical cam is connected to a control lever for forward, neutral and reverse controls. A link arm is pivotally connected to the cam at one end and to a rocking lever to the throttle. A slide member is pivotally connected to the cam and an electromagnet or solenoid. The rocking lever, slide and the electromagnet are further supported by a support plate. The reliance on a plurality of connecting parts to the cam and the use of an electromagnet solenoid distinguishes this apparatus.

U.S. Pat. No. 5,603,644 issued on Feb. 18, 1997, to Noboru Kobayashi et al. describes a jet propulsion boat with indicating means for visual warning to following vessels when the boat is suddenly braked. Various shift gate options are described for applying reverse and full slow throttle positions. The apparatus is distinguishable because no cam element is described to obtain the aforementioned relationship between the reverse and speed controls.

U.S. Pat. No. 5,494,464 issued on Feb. 27, 1996, to Noboru Kobayashi et al. describes pedal controls for a pair of jet propulsion boat engines with reverse buckets controlled by either one foot or each pedal operated independently. An interlock system and a detent mechanism are provided for holding the pedals and the reverse thrust bucket in a neutral position. The apparatus is distinguishable because no cam operation and dual function single lever control are described.

U.S. Pat. No. 4,973,274 issued on Nov. 27, 1990, to I. Hirokawa describes a shift assisting device for a marine outboard transmission that includes a sensing device comprises a pair of movable levers with pressure responsive switches being effective to transmit movement between the levers, and to provide a shift controlling signal when the resistance to movement exceeds a predetermined value. The device is distinguishable as being based on an electronic system and the lack of a suggestion for cam operation.

U.S. Pat. No. 4,753,618 issued on Jun. 28, 1988, to David C. Entringer and 4,952,181 issued on Aug. 28, 1990, to David C. Entringer et al. describes a shift cable assembly for a marine drive having a clutch and gear assembly. The control cable is connected to a shift lever on a shift plate. A shift guide assembly with springs is also connected to the shift lever. The assembly is distinguishable because no cam operation is required.

Russia Patent No. SU-713-769 issued on Feb. 10, 1980, describes a two-rope transmission for an outboard boat engine throttle and reverse remote control, wherein the reverse lever is attached to a profiled slider, freely set pulley and throttle lever with a clamp and stop pin. This apparatus is distinguishable for lacking a cam operation.

None of the above inventions and patents, taken either singularly or in combination, is seen to describe the instant invention as claimed. Thus, a dual function single lever control apparatus which is economical, simple to install, and simple in operation is desired.

SUMMARY OF THE INVENTION

Accordingly, it is a principal object of the invention to provide a dual function control lever apparatus.

It is another object of the invention to provide a dual function control lever apparatus for any watercraft with a jet pump drive.

It is a further object of the invention to provide a dual function control lever apparatus which can be retrofitted to a watercraft with a jet pump drive unit.

Still another object of the invention is to provide a dual function control lever apparatus which is economical and simple to install on a watercraft with multiple jet pump drive units.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides a dual function control lever apparatus for either retrofitting to a jet propulsion pump of a boat or including during manufacture of the boat.

Figure 1:
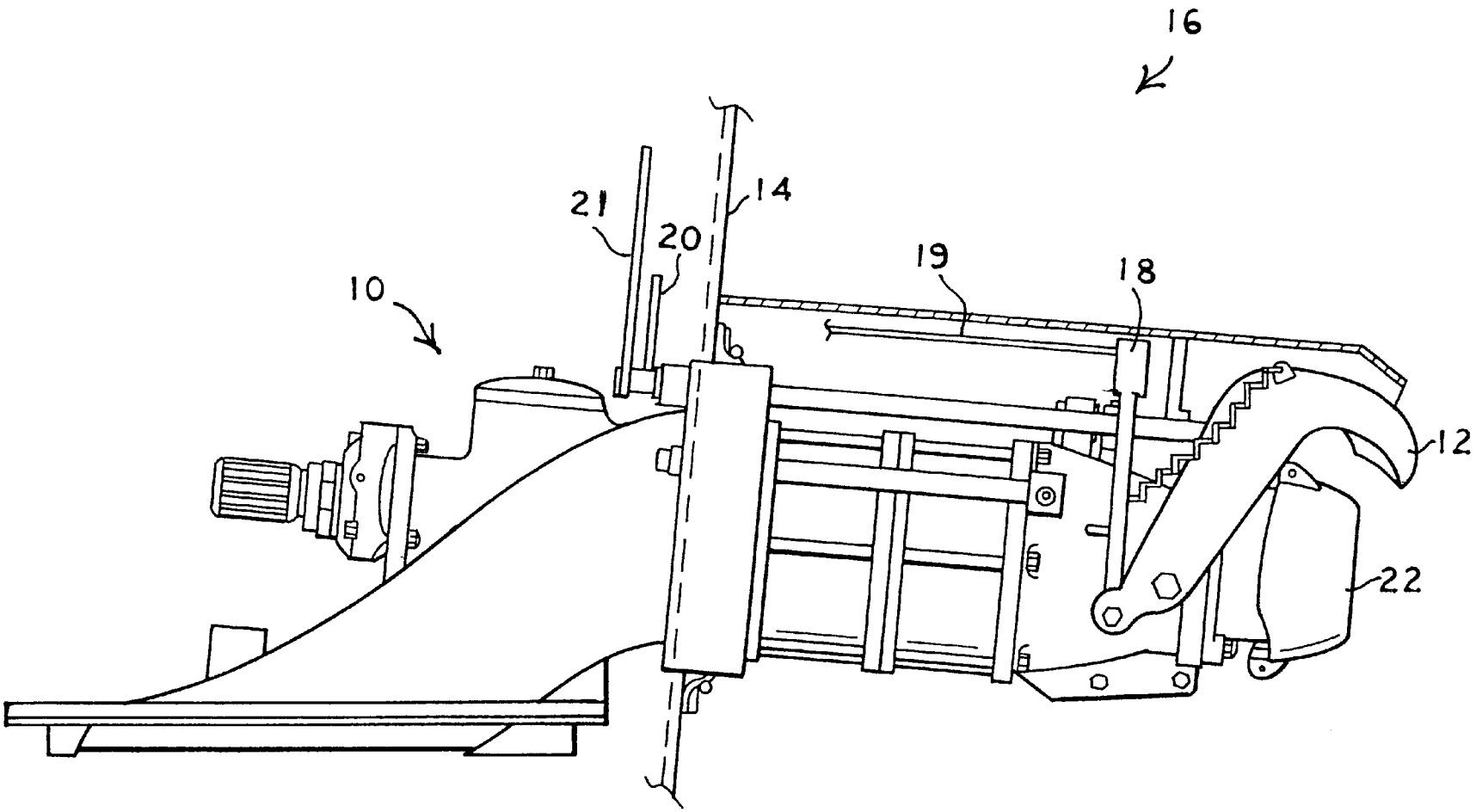
FIG. 1 is a side view of a conventional jet propulsion pump that is mounted in a boat transom.

FIG. 1 illustrates one type of a marine jet propulsion pump 10 with a reverse thrust bucket 12 installed in the transom 14 of a boat 16. The bucket 12 is held up and controlled with a yoke 18 via a yoke rod 19 and a bucket shift rod 20, respectively. The steering rod 21 controls the direction of the jet nozzle 22 for steering the boat 16. The bucket 12 is positioned over the pump's water jet nozzle 22 for operation in the reverse mode.

Figure 2:
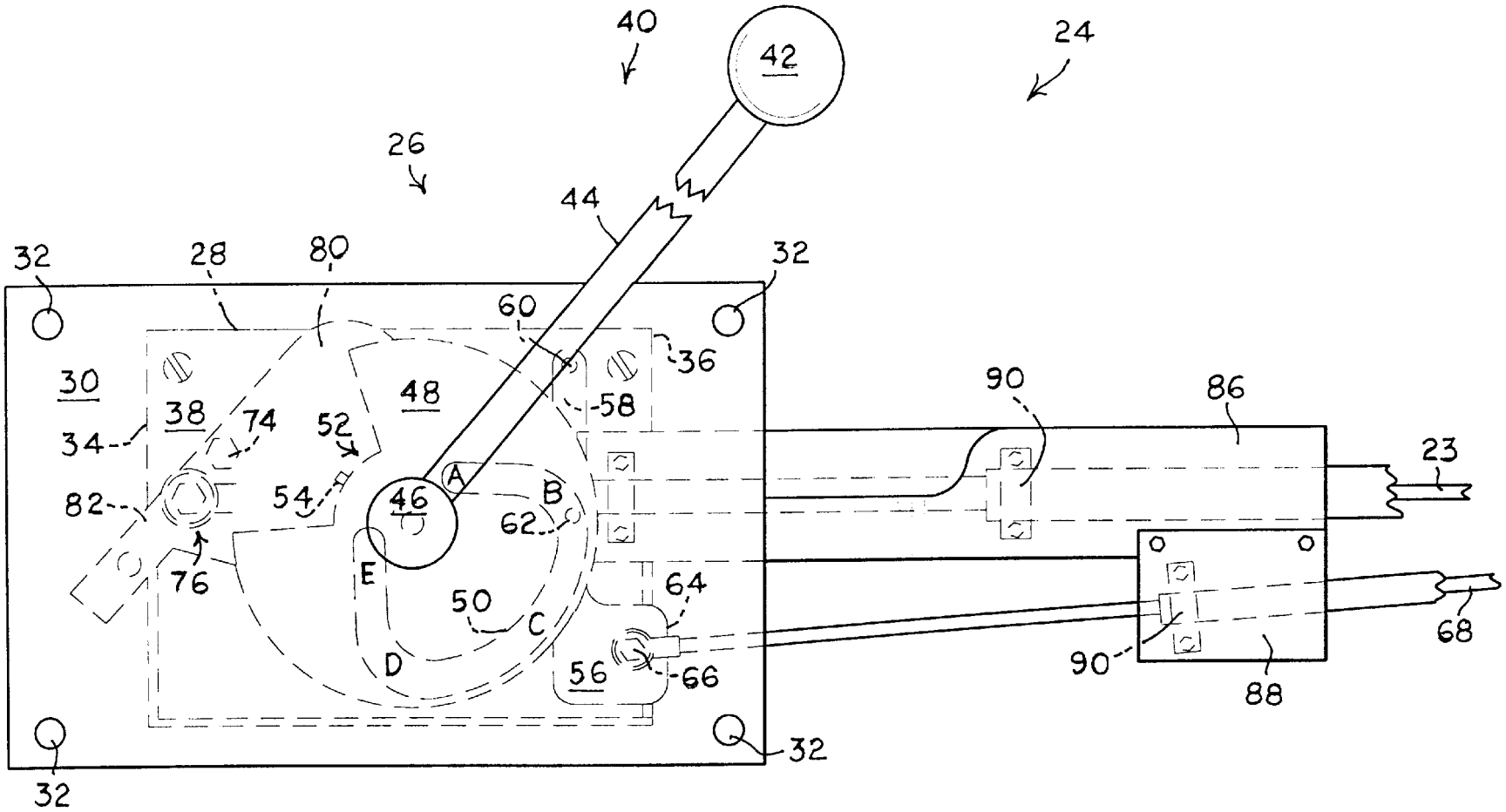
FIG. 2 is a front view of the dual function single lever control with the internal parts partially in shadow according to the present invention.
Figure 3:
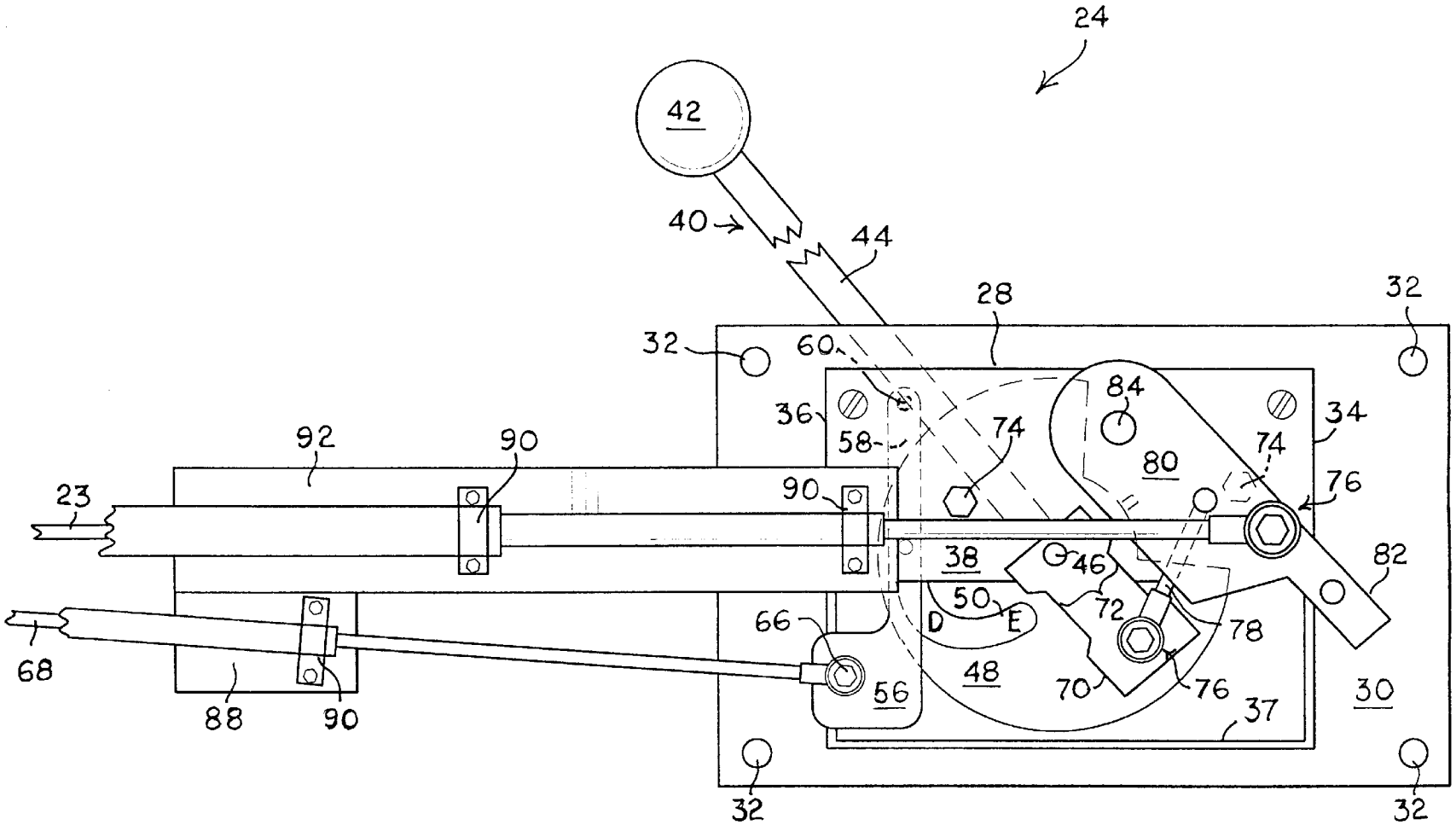
FIG. 3 is a rear view of the dual function single lever control according to the present invention.
Figure 4:
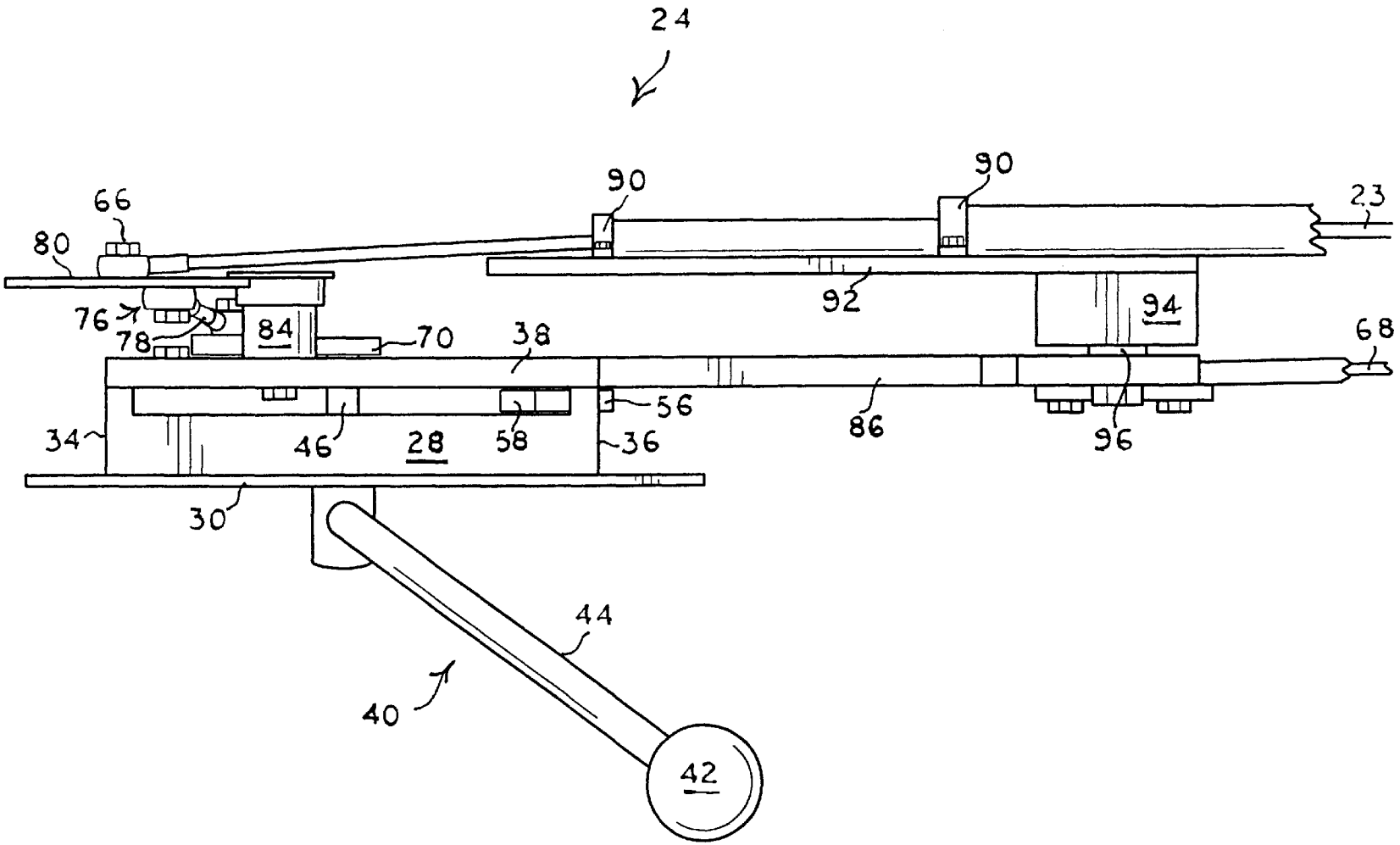
FIG. 4 is a top view of the dual function single lever control.

FIGS. 2, 3 and 4 show, respectively, a front view (hidden parts in shadow), a rear view (hidden parts in shadow) and a top view of the control unit 24. The control unit 24 can be mounted either on an inner side of the hull or on a dashboard. A frame or housing 26 has a top wall 28, an extensive outside or front wall 30 with corner holes 32 for mounting on a surface, a left sidewall 34, a right sidewall 36, a bottom wall 37, and a bottom limited inside or rear wall 38. A combined throttle and shift lever 40 having a knob 42 on a shaft 44 is rotatably movable on an axle 46 which also rotates a planar truncated circular cam 48. The cam 48 has a curvilinear groove 50 with a base portion C and two legs at A to B and D to E (shown in FIG. 2) which approach each other at its ends A and E, and form an acute angle with the base portion C. The cam 48 has an indented portion 52 for placement of a set screw 54 in FIG. 4 to affix the position of the cam 48 on the axle 46.

FIGS. 2 and 3 show a dog-leg shaped planar cam follower arm 56 having a narrow end 58 attached inside the control unit 24 to the rear wall 38 by a pivot pin 60. A median portion has a follower roller pin 62 which follows the groove 50 of the cam 48. The opposite wide end 64 has a removable ball joint stud 66 for attachment of the throttle cable 68 from a jet engine. The rear wall 38 being limited in height as aforementioned provides clearance for the cam follower arm 56 and the ball joint stud 66. The travel of the throttle and shift lever 40 is approximately 180° from a horizontal position.

The axle 46 extends through the rear wall 38 of the housing 26 and is welded at one end to a first connector element 70 which has a narrowed portion with indentations 72 on both sides which cooperate with stops or bolts 74 placed in a series of apertures (not shown) in the rear wall 38 to limit the throw of the throttle and shift lever 40 to approximately 180°.

The first connector element 70 is connected to two other connector elements to the yoke cable 19. The second connector element 78 is cylindrical and pivots from the opposite end of the first connector element 70 on a ball joint 76. An opposite end of the second connector element 78 pivots on another ball joint 76 of a third connector element 80 which is planar and shaped with a finger 82 at one end and rotatably attached to the rear wall 38 at the top wall 28 on a large pin 84.

The rear wall 38 is configured to have a planar extension 86 seen in FIGS. 2 and 4. An extension bracket 88 is fastened on the end portion of the extension 86 by a hold-down bracket 90 to support the bucket shift cable 23.

The rear wall 38 has a long rectangular support bracket 92 attached to it for supporting the bucket shift 23 by two hold-down brackets 90. A spacer block portion 94 rotatably secured by a pin 96 separates the support bracket 92 from the rear wall 38 as best seen in FIG. 4. The clearance is necessitated by the space required by the connector elements 70, 78 and 80.

The operation of the control unit 24 will now be explained. The movement of the throttle and shift lever 40 vis-a-vis the movement of the follower roller pin 62 of the cam follower arm 56 in the groove 50 of the cam 48 and the resulting controlling motions of the throttle cable 68 and the bucket shift cable 23 will be explained with reference to points A, B, C, D, and E as shown in FIG. 2. At point A, the throttle and shift lever 40 is fully forward and in a horizontal position as viewed from the front wall 30 of the control unit 24. The bucket shift cable 23 (connected to the bucket shift rod 20 in FIG. 1) and the reverse thrust bucket 12 are fully retracted, but the throttle cable 68 is extended slightly to continue idling the engine 10. At point B, the bucket 12 has been moved slightly down by an extension of the bucket shift cable 23 approximately one-sixth of its extendible length, and the throttle cable 68 has been extended approximately half its length.

At point C which is the center of the path in the groove 44, the bucket shift cable 23 has been retracted another one-sixth of its length to lower the reverse thrust bucket 12 another distance. The throttle cable 68 has not been moved. At point D, the bucket shift cable 23 has been extended two-thirds of its length, and the bucket 12 has moved further over the jet pump nozzle 22. The throttle cable 68 has been retracted approximately one-fourth of its length. At point D, the bucket shift cable 20 has been extended approx-imately two-thirds of its extension length, and the bucket 12 has almost covered the jet pump nozzle 22. The throttle cable 68 has been retracted two-thirds of its length. At point E, the throttle and shift lever 40 is back to horizontal with the bucket shift cable 23 fully extended for complete coverage of the jet pump nozzle 22 by the reverse thrust bucket 12 with the bucket shift cable 20 fully retracted.

In summarizing the rotation movement of the throttle and shift lever 40, the lever shaft 44 is first rotated 15° for a reversing position. The lever shaft is then rotated 105° for a shifting or neutral position. Finally, the lever shaft is rotated 60° for a forward throttle position.

The significant advantages of the present invention are as follows. The shift-throttle lever of the prior art devices must use greater leverage for shifting to reverse by rotating the lever only 60°, whereas the throttle and shift lever 40 of the present invention must rotate at least 120° or twice the arc. Since the control unit 24 has no breakaway point and no dead time where the bucket shift cable 20 stops travelling during the throttling mode, the reverse mode can be more efficiently utilized in the operation of a marine jet propulsion pump 10. In the reverse mode starting from the top of the stroke, there is no movement of the bucket shift cable 20, and only one-third of the throttle RPM need be used to prevent cavitation. In the forward mode, once the reverse thrust bucket 12 is above the stream of water, the boat 14 is moving forward.

It is to be understood that the present invention is not limited to the embodiment described above, but encompasses any and all embodiments within the scope of the following claims.

I claim:

1. A dual function single lever control apparatus for operating the reverse thrust bucket and throttle for a jet propulsion pump of a watercraft comprising:

a frame having a front wall, a top wall, a right sidewall, a left sidewall, and an abbreviated rear wall;

an axle supported by said front and rear walls of said frame;

a throttle and shift lever positioned outside said front wall of said frame and connected to and driving said axle, a planar truncated circular cam within said frame and rotating on said axle, and including a curvilinear groove made up of a base with two legs;

a bucket control cable and a throttle control cable;

a cam follower arm having a first end pivoting on a pin, a median portion affixed to a roller pin which travels within said curvilinear groove, and a second end connected to said throttle control cable;

an interconnection system of a first connector element, a second connector element and a third connector element, wherein said first connector element being attached to said axle at one end and the opposite end thereof pivotally attached to one end of said second connector element, an opposite end of said second connector element pivotally attached to a median portion of said third connector element, and said third connector element pivotally attached to said rear wall at one end and pivotally attached to said bucket shift cable;

whereby, by rotating said throttle and shift lever, said bucket shift cable is fully advanced to implement a reverse condition, and said throttle control cable is fully advanced and slightly retracted to implement the dual function of the single lever control apparatus.

2. The apparatus according to claim 1, including an extension on said rear wall for supporting said bucket control cable.

3. The apparatus according to claim 2, including an extension bracket on said extension of said rear wall for supporting said throttle control cable.

4. The apparatus according to claim 3, including a support bracket with a spacer block for supporting said bucket shift cable.

5. The apparatus according to claim 1, including two projecting stops based on the outer surface of said rear wall, said first connector element being limited in travel during rotation by said two projecting stops.

6. The apparatus according to claim 5, further including a series of apertures on said rear wall for adjustment of said two projecting stops.

7. The apparatus according to claim 1, said cam configured with an indentation for supporting a set screw, said cam being adjustably positioned on said axle by said set screw.

8. The apparatus according to claim 1, wherein said throttle and shift lever is dimensioned and configured to rotate approximately 180°.

9. The apparatus according to claim 1, wherein said throttle and shift lever is rotated 15° for a reversing position.

10. The apparatus according to claim 1, wherein said throttle and shift lever is rotated 105° for a shifting or neutral position.

11. The apparatus according to claim 1, wherein said throttle and shift lever arm is rotated 60° for a forward throttle position.

* * * * *